US007114291B2

(12) United States Patent
David

(10) Patent No.: US 7,114,291 B2
(45) Date of Patent: Oct. 3, 2006

(54) OVERHEAD DOOR DROP STOP

(75) Inventor: Kenneth David, St Louis, MO (US)

(73) Assignee: Enterprise Safety Products I, L.L.C., St. Louis, MO (US)

( * ) Notice: Subject to any disclaimer, the term of this patent is extended or adjusted under 35 U.S.C. 154(b) by 0 days.

(21) Appl. No.: 10/947,622

(22) Filed: Sep. 23, 2004

(65) Prior Publication Data

US 2005/0072535 A1 Apr. 7, 2005

Related U.S. Application Data

(63) Continuation of application No. 10/102,315, filed on Mar. 21, 2002, now abandoned.

(51) Int. Cl.
*E05D 13/00* (2006.01)

(52) U.S. Cl. ..... 49/322; 49/197; 160/201

(58) Field of Classification Search ..... 160/189, 160/191, 201, 232, 235, 133; 242/107; 49/322, 49/197

See application file for complete search history.

(56) References Cited

U.S. PATENT DOCUMENTS 1,876,750 A * 9/1932 Reed ..... 160/133
3,212,560 A * 10/1965 Buehler ..... 160/191
3,217,784 A * 11/1965 Wolf et al. ..... 160/113
3,258,293 A * 6/1966 Sharp ..... 297/483
3,343,623 A * 9/1967 Porter ..... 280/802
3,351,382 A * 11/1967 Davies ..... 297/475
3,763,594 A * 10/1973 Banzei ..... 49/126
4,026,343 A * 5/1977 James ..... 160/189
4,272,104 A * 6/1981 Cuny ..... 280/801.1
4,727,919 A * 3/1988 Kraeutler ..... 160/84.02
4,763,926 A * 8/1988 Doty ..... 280/808
4,940,193 A * 7/1990 Grabowski ..... 242/381.2
4,997,022 A * 3/1991 Klein ..... 160/265
5,010,688 A * 4/1991 Dombrowski et al. ..... 49/362
5,184,864 A * 2/1993 Teigen et al. ..... 296/186.4
5,768,828 A * 6/1998 Wilson ..... 49/386
6,484,784 B1 * 11/2002 Weik et al. ..... 160/7
6,862,845 B1 * 3/2005 Schiks ..... 49/322
2003/0098603 A1 * 5/2003 Ruff ..... 297/464

FOREIGN PATENT DOCUMENTS

GB 2250778 * 6/1992 ..... 182/189 X

* cited by examiner

*Primary Examiner*—David Purol
(74) *Attorney, Agent, or Firm*—Blumenfeld, Kaplan & Sandweiss, P.C.

(57) ABSTRACT

A door drop stop safety system which is adapted to be installed on existing building overhead doors which employ a central axle; slab doors, bifold doors, and rollup doors which contains structure for raising and lowering the the door including a rewind box including an inertia reel and a length of strap. The inertia reel allowing normal motion, but is adapted to lock as soon as a predetermined rate of rotation is reached due to the door beginning to free fall. The system includes structure means for mounting the rewind box on an existing door, including slab doors, bifold doors, and rollup doors.

1 Claim, 12 Drawing Sheets

OVERHEAD DOOR DROP STOP

A. REFERENCE TO RELATED APPLICATION

This application is a continuation of application Ser. No. 10/102,315 filed Mar. 21, 2002 now abandoned.

I. FIELD OF THE INVENTION

This invention relates to a stop mechanism, specifically to halt the sudden drop of an overhead or other vertically moving door in the event of a failure.

II. BACKGROUND OF THE INVENTION

A door may comprise a single heavy slab or a plurality of connected door segments, the sum of which are very heavy. Various means exist to aid in lifting the door, such as counterweights, torsion springs, and lifting cables. These aids effectively counteract the weight of the door which allows it to be easily lifted by manual or mechanical means. In the event any element of the aforementioned means breaks, the door can fall rapidly, causing possible property damage, injury, or even death.

Numerous methods have been employed to stop a door after such a failure, but they are either expensive, complicated, and/or difficult to install without extensive modifications.

U.S. Pat. No. 2,185,828 discloses a safety catch for vertically sliding doors. While this invention purports to be installable on existing door systems, the installation requires removing parts from the existing door and either moving them or substituting other parts. It is also relatively complicated, comprising numerous moving parts which must interact in order to achieve its purpose.

U.S. Pat. No. 5,494,093 discloses a rolling door stop apparatus. This invention is intended primarily to arrest the uncontrolled fall of a rolling door, which, as opposed to an overhead door, is rolled up and down much like a window shade. While this invention could be utilized on an overhead type door, its installation would be difficult and time-consuming if performed on an existing door.

U.S. Pat. No. 6,024,155 discloses a truck doorstop. This invention is intended to prevent a truck-mounted overhead door from falling closed due to sudden motion of the truck. This invention actually redirects the bottom door segment after the door is fully open, forcing the door to move laterally in the event the truck is moved. There is no provision to prevent the door from free-falling during opening or closing, if the counterbalance system fails.

III. SUMMARY OF THE INVENTION

A. Objects of the Invention

One object of the present invention is to prevent personal injury and/or damage caused by a falling door.

Another object of the present invention is to provide a door drop stop system which can be installed on any existing door with minimal modifications to the door system.

Another object of the present invention is to provide a door drop stop system which works equally well on commercial, residential, or truck-mounted doors.

Another object of the present invention is to provide a door drop system which is very economical to purchase.

B. Summary

The present invention is a door drop stop system designed to require a minimal amount of time and modification to install in an existing door system. It is effective with all overhead doors which employ a central axle; such overhead doors are in widespread use in residential, commercial, and vehicular applications. In addition, other configurations of the door drop stop system are effective with slab doors, bifold doors, and rollup doors. The present invention will reduce or eliminate property damage and personal injury resulting from a failure of a component of the door or its counterbalance system.

IV. THE DRAWINGS

V. DESCRIPTION OF PREFERRED EMBODIMENTS

Figure 1A:
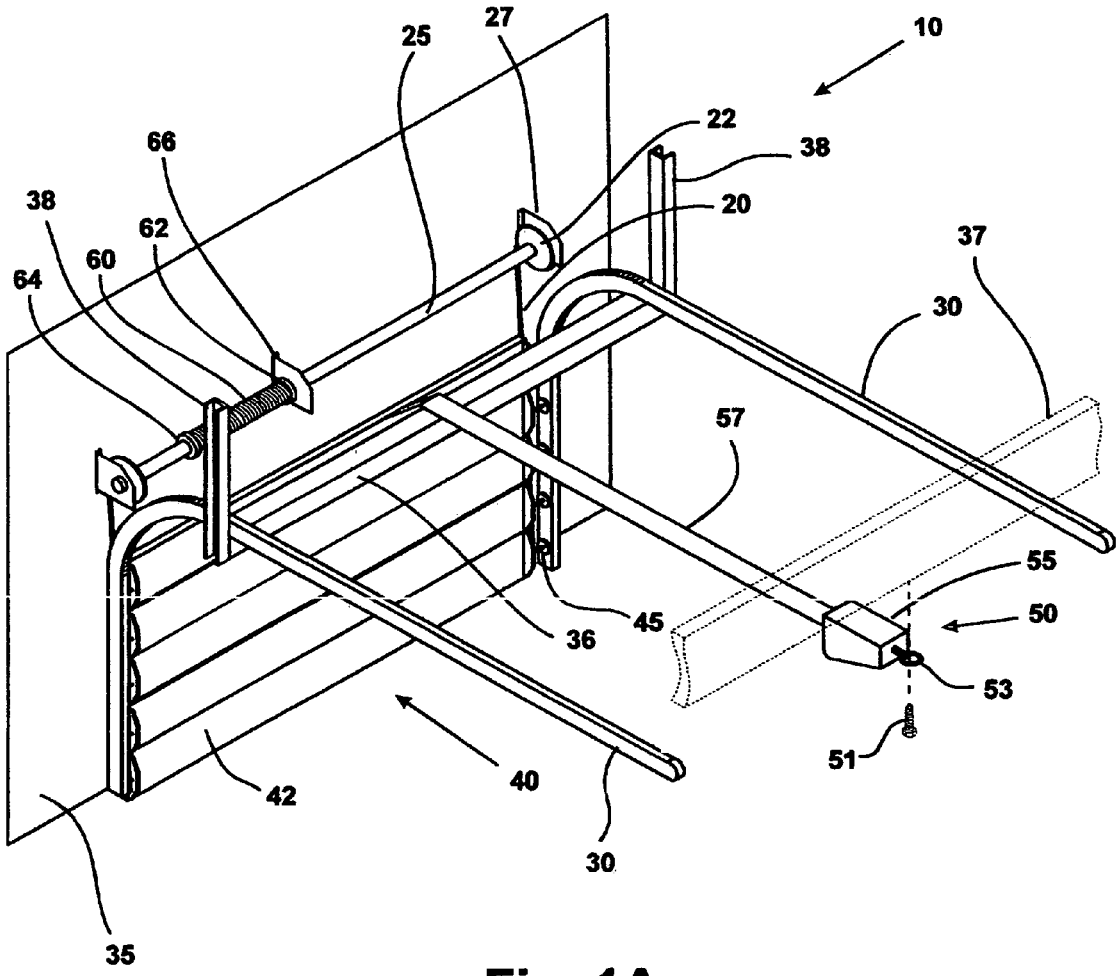
FIG. 1A is a perspective overall view of the present invention installed on an overhead door, shown in the closed position.
Figure 1B:
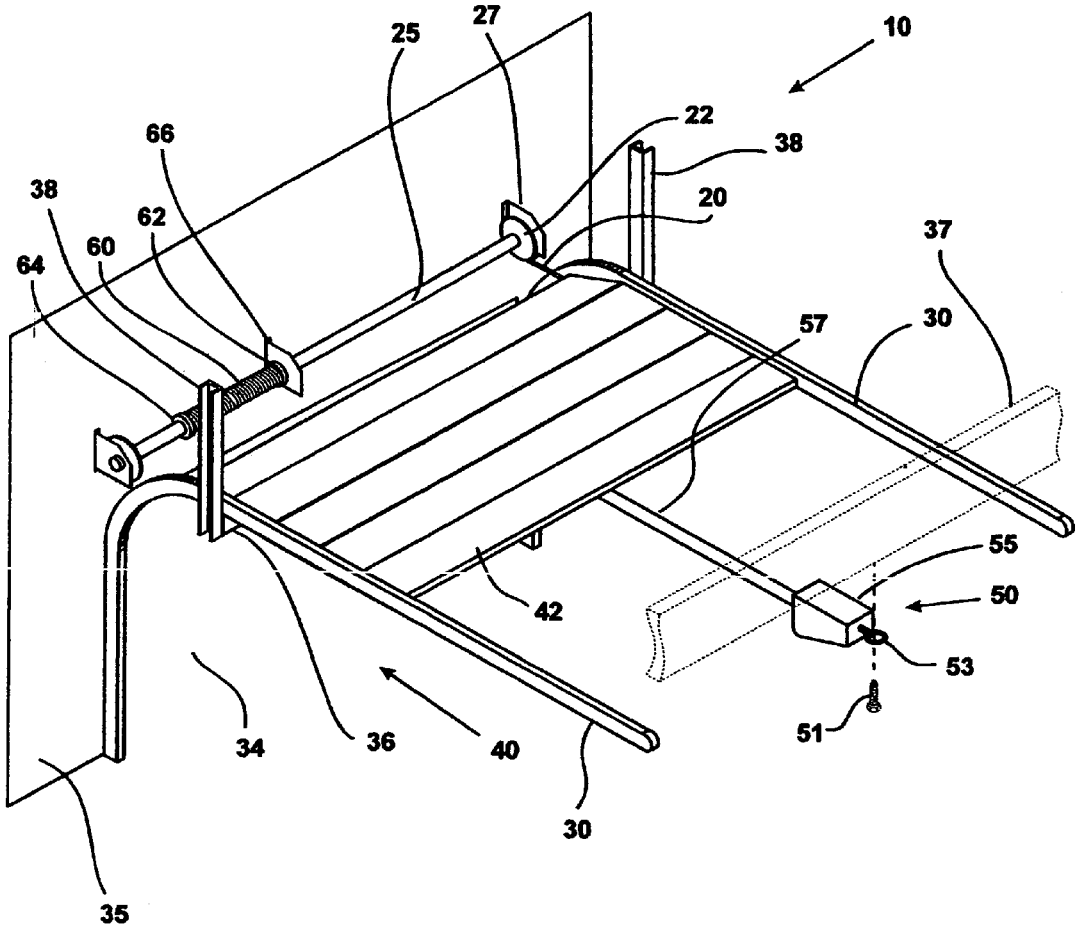
FIG. 1B is a perspective overall view of the present invention installed on an overhead door, shown in the open position.

In accordance with the present invention, FIGS. 1A and 1B show a typical overhead door system with the door drop stop system installed, generally at 10.

The overhead door system is well known in the art. The following is a description of normal overhead door operation: In FIG. 1A, door 40 is shown in the closed position and comprises a plurality of door segments 42. Door 40 is heavy, and some means of counterbalancing that weight is needed, such as a torsion spring counterbalance. One end of torsion spring 60 is anchored to axle 25 by means of rotating spring mount 64. The other end of torsion spring 60 is anchored to center axle mount 66 by means of fixed spring mount 62. Mounted to the ends of axle 25 are pulley reels 22. Axle 25 and pulley reels 22 are free to rotate about their longitudinal axis and are mounted to wall 35 by outer axle mounts 27 and center axle mount 66. Cables 20 are affixed to both ends of bottom door segment 42, and to pulley reels 22.

With the overhead door is in the down position, torsion spring 60 is wound tightly, exerting a rotating force on axle 25 and hence to pulley reels 22. The weight of door 40 is transferred to pulley reels 22 by cables 20, and is slightly greater than the rotating force, which prevents axle 25 from rotating. When enough upward force is exerted on door 40, either by manual or mechanical means, torsion spring 60 begins unwinding, assisting in the upward motion of door 40 by turning axle 25 and pulley reels 22, winding cables 20 onto pulley reels 22. Rollers 45 are mounted on both ends of door segments 42 and ride inside tracks 30. As each door segment 42 reaches the curved portion of tracks 30, it articulates inward, coming to rest in a perpendicular orientation to its open position.

Conversely, when the overhead door is being closed, torsion spring 60 resists the downward motion of door 40, allowing it to be closed slowly and safely. Torsion springs and cables are subjected to a great deal of stress over the years, and are well known to fail. In the event torsion spring 60 or cables 20 should fail while door 40 is in motion, no such resistance will be applied to door 40, allowing it to free fall.

Door drop stop system 50 comprises rewind box 55, strap 57, vertical brace members 38, and horizontal brace member 36. Vertical brace members 38 are mounted to any convenient overhead structure in the area. Horizontal brace member 36 is connected to vertical brace members 38 at each end, and is routed under door tracks 30. Rewind box 55 is mounted to fixed structure 37 by mounting lugs 53 and mounting means 51, which may be a lag bolt or any other fastener appropriate to the nature of fixed structure 37. Strap 57 is attached to one door segment 42 by attaching means 78 applied through a hole drilled in door segment 42. Strap 57 is routed over horizontal brace member 36 to rewind box 55. Rewind box 55 comprises a housing 56 and an inertia reel 70. Inertia reels are well known in the art and are commonly used in automotive and aircraft seat belt systems, as well as in safety devices for workers in hazardous locations. They allow normal movement, but will arrest any sudden motion. Strap 57 is wound onto inertia reel 70.

If torsion spring 60 or cable 20 breaks, or other failure occurs, door 40 will attempt to free fall, causing the rapid unwinding of strap 57 from inertia reel 70. Inertia reel 70 will lock, halting the unwinding movement of strap 57, and arresting the downward motion of door 40.

Inertia reel 70 can be easily unlocked by exerting a slight upward motion on door 40. Safe means of lowering door 40 can now be employed.

FIG. 1B shows the open overhead door and door opening 34. In the event of any failure which would cause the door to come out of tracks 30, the door segments will be caught by horizontal brace member 36, and nylon strap 57.

Figure 2A:
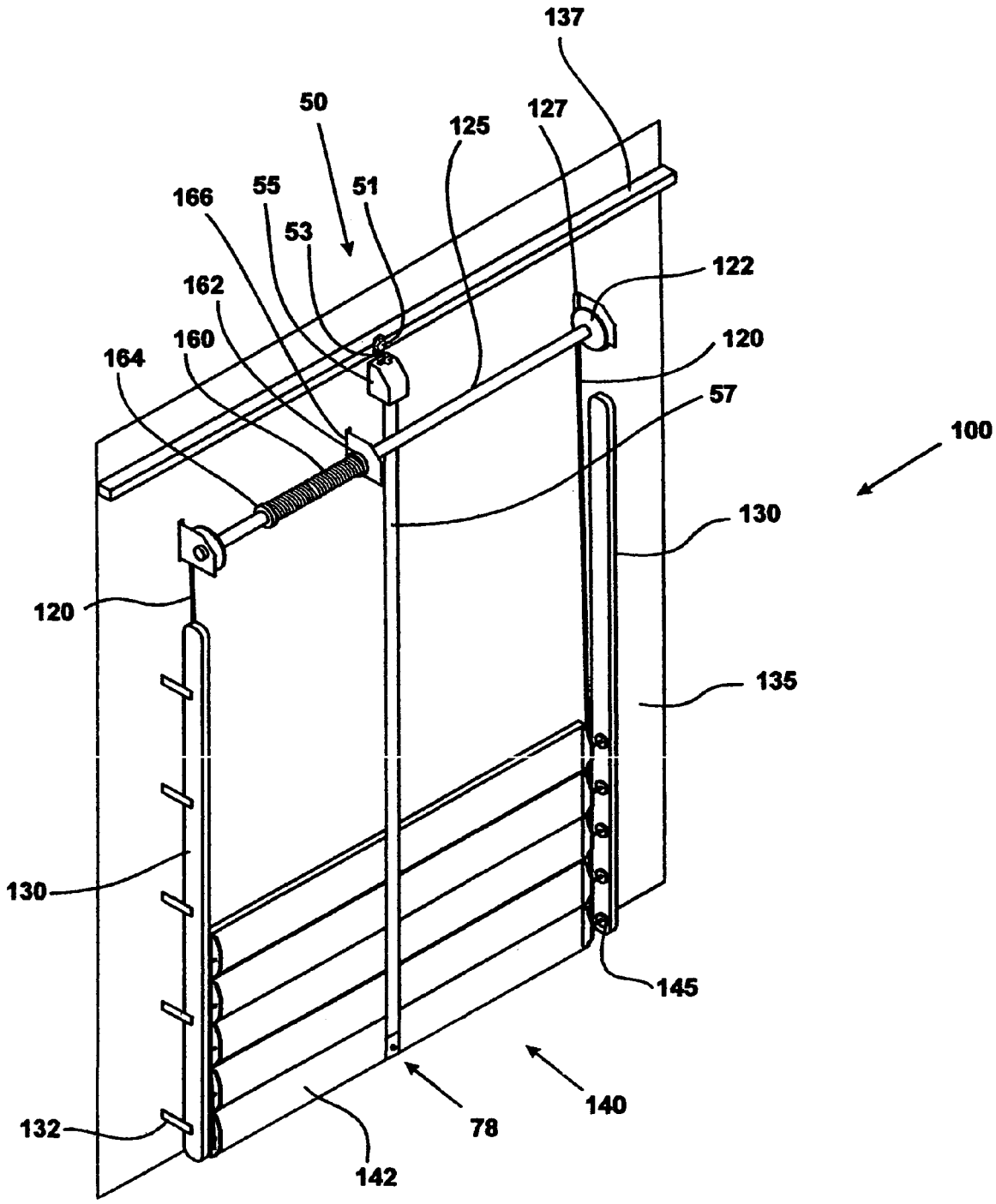
FIG. 2A is a perspective overall view of the present invention installed on a high lift door, shown in the closed position.
Figure 2B:
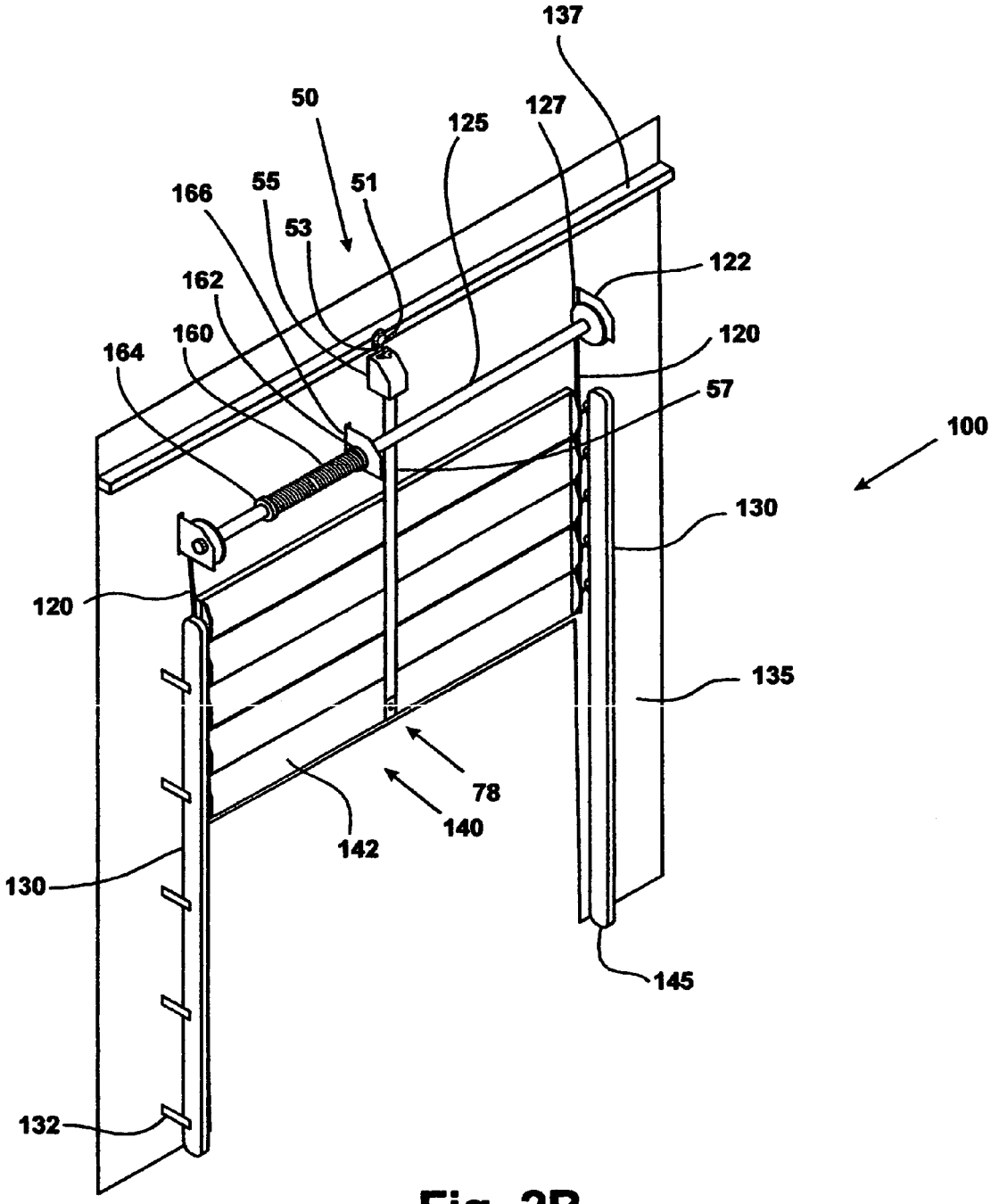
FIG. 2B is a perspective overall view of the present invention installed on a high lift door, shown in the open position.

FIGS. 2A and 2B show a high lift door in the open and closed positions, respectively at 100. A high lift door operates very much like an overhead door, except that the wall it is mounted on is tall enough to allow the door to open straight up. Therefore, the door does not articulate around a curved track Straight tracks 130 are used, which are mounted to wall 135 by means of mounting brackets 132.

Door drop stop system 50 comprises rewind box 55 and strap 57. Rewind box 55 is mounted to fixed structure 137 by mounting lugs 53 and mounting means 51, which may be a lag bolt or any other fastener appropriate to the nature of fixed structure 137. Strap 57 is attached to one door segment 142 by mounting means 78 applied through a hole drilled in door segment 142. Strap 57 is routed straight up door 140 to rewind box 55. Rewind box 55 comprises housing 56 and inertia reel 70. Inertia reels are well known in the art and are commonly used in automotive and aircraft seat belt systems, as well as in safety devices for workers in hazardous locations. They allow normal movement, but will arrest any sudden motion. Strap 57 is wound onto inertia reel 70.

If torsion spring 160 or cable 120 breaks, or other failure occurs, door 140 will attempt to free fall, causing the rapid unwinding of strap 57 from inertia reel 70. Inertia reel 70 will lock, halting the unwinding movement of strap 57, and arresting the downward motion of door 140.

Inertia reel 70 can be easily unlocked by exerting a slight upward motion on door 140. Safe means of lowering door 140 can now be employed.

Figure 3:
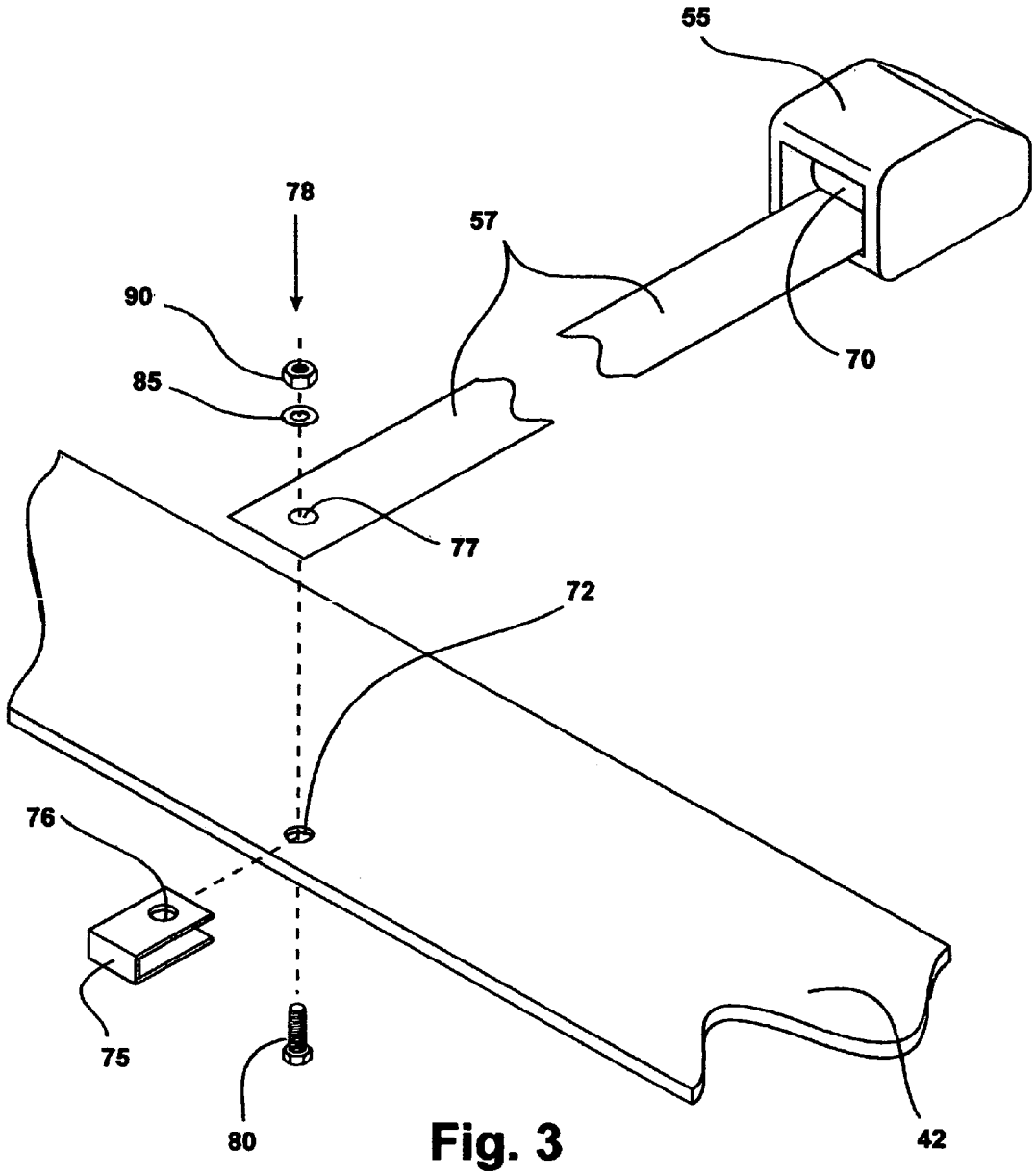
FIG. 3 is a perspective view of the present invention, detailing how it is installed to a segment of an existing overhead door.

FIG. 3 shows strap 57, rewind box 55, and inertia reel 70. Door segment 42 is modified by drilling hole 72. Mounting means 78 comprises mounting bracket 75, bolt 80, one or more washers 85, and nut 90. Strap 57 is placed against door segment 42 with hole 77 matching the position of hole 72. Mounting bracket 75 is fitted over the end of door segment 72 with its holes 76 corresponding to holes 72 and 77. Strap 57 is captured between mounting bracket 75 and door segment 42. Bolt 80 is inserted through one of mounting bracket holes 76, door segment 42 hole 72, strap 57 hole 77, and the second hole 76 in mounting bracket 75. Washer 85 is placed onto bolt 80 and nut 90 is threaded onto bolt 80 and tightened.

Mounting bracket 75 serves as a reinforcement to door segment 42 to prevent the tightening of bolt 80 and nut 90 from crushing door segment 42.

Figure 4A:
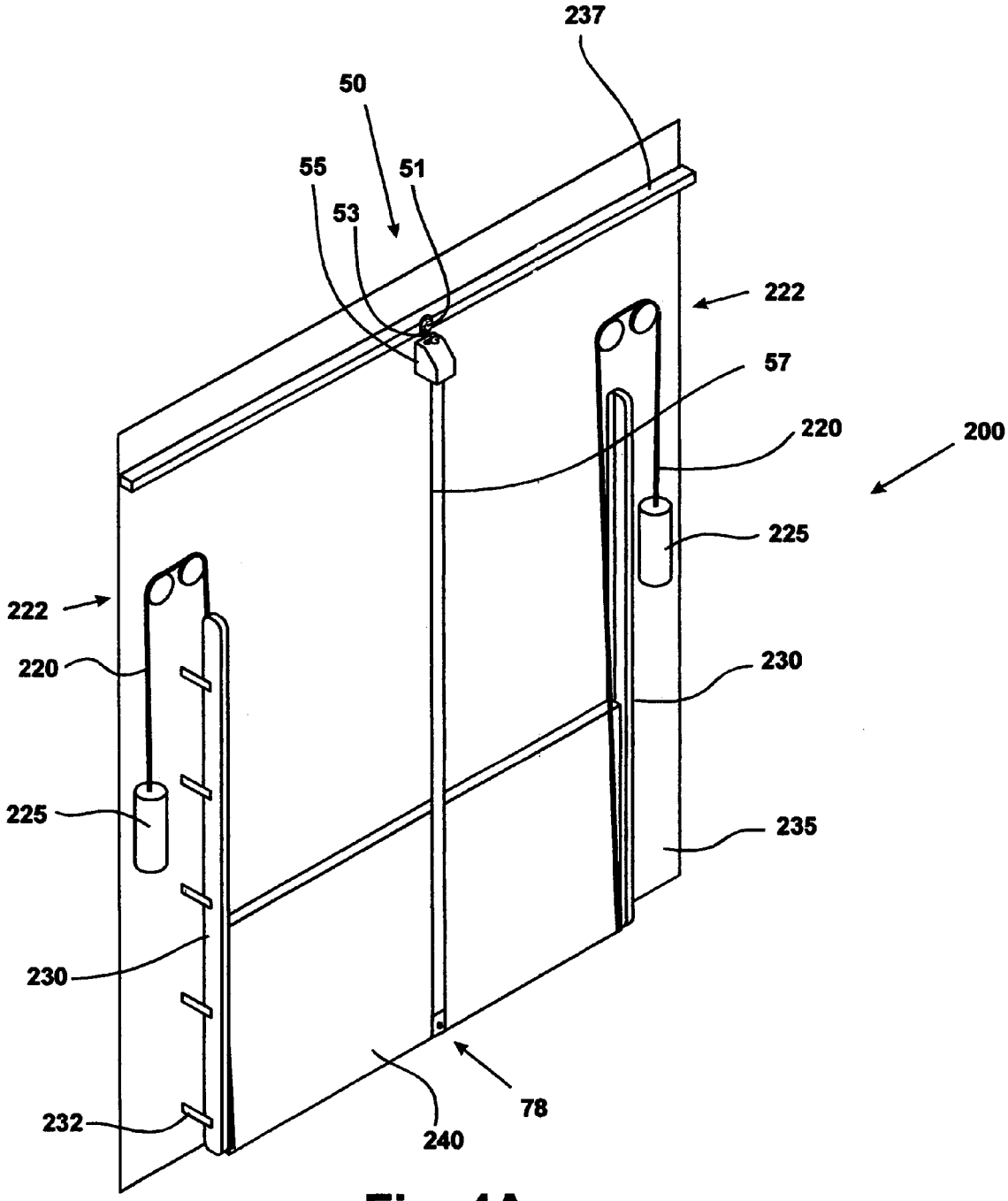
FIG. 4A is a perspective overall view of the present invention installed on a slab door, shown in the closed position.
Figure 4B:
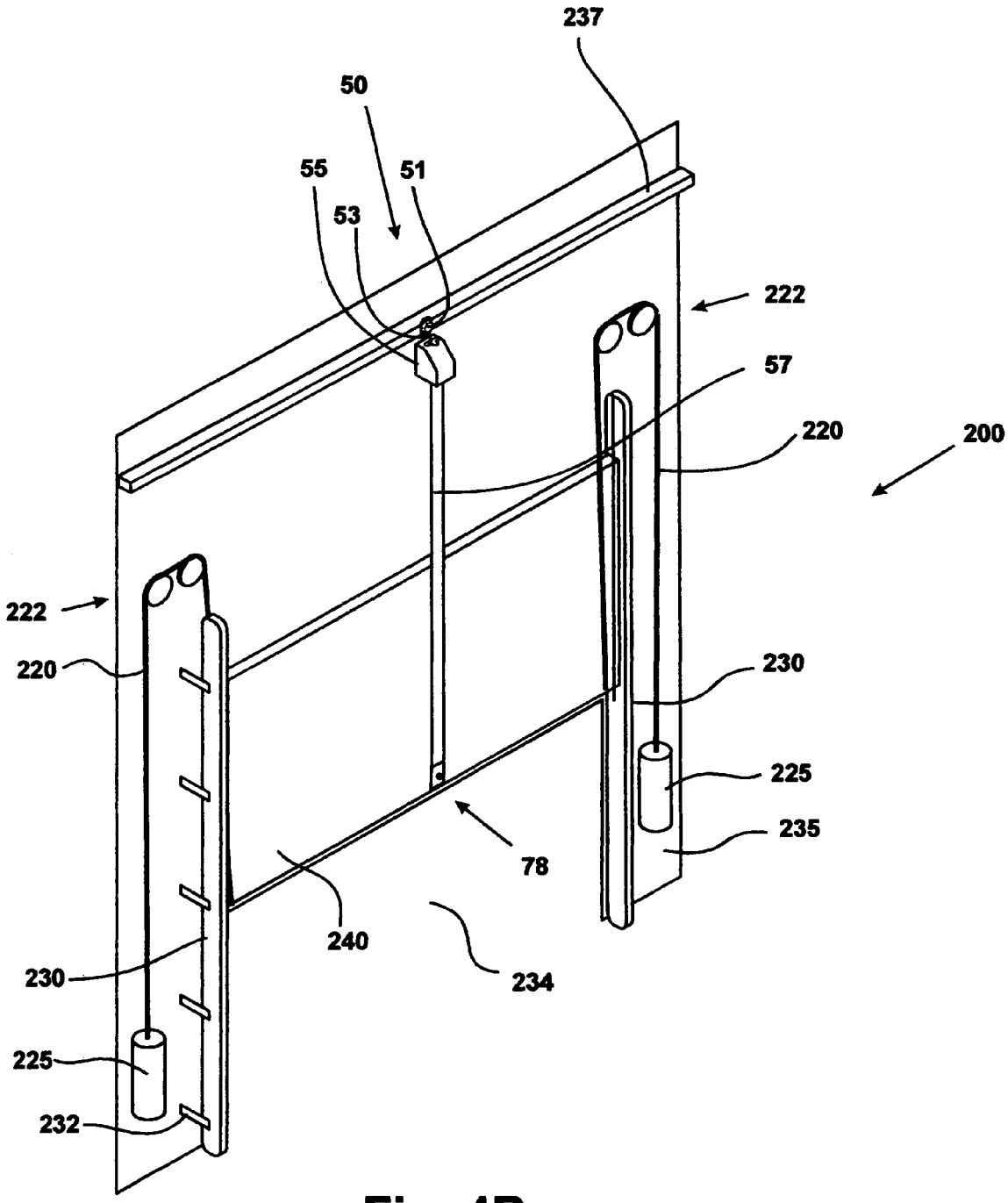
FIG. 4B is a perspective overall view of the present invention installed on a slab door, shown in the open position.

FIGS. 4A and 4B show a slab door in the open and closed positions, respectively at 200. A slab door system comprises door 240, tracks 230, mounting brackets 232, cables 220, pulleys 222, and counterweights 225. The weight of slab door 240 is compensated for by counterweights 225. Counterweights 225 are connected to door 240 by means of cable 220 which is routed over pulleys 222 to the bottom of door 240. Therefore, when a relatively slight upward motion is exerted upon door 240, the door will move up on tracks 230, allowing counterweights 225 to move downward.

Door drop stop system 50 comprises rewind box 55 and strap 57. Rewind box 55 is mounted to fixed structure 237 by mounting lugs 53 and mounting means 51, which may be a lag bolt or any other fastener appropriate to the nature of fixed structure 237. Strap 57 is attached to door 240 by mounting means 78 applied through a hole drilled in door 140.

Strap 57 is routed straight up door 240 to rewind box 55. Rewind box 55 comprises housing 56 and inertia reel 70. Inertia reels are well known in the art and are commonly used in automotive and aircraft seat belt systems, as well as in safety devices for workers in hazardous locations. They allow normal movement, but will arrest any sudden motion. Strap 57 is wound onto inertia reel 70.

If cable 220 breaks or other failure occurs, door 240 will attempt to free fall, causing the rapid unwinding of strap 57 from inertia reel 70. Inertia reel 70 will lock, halting the unwinding movement of strap 57, and arresting the downward motion of door 240, preventing it from causing injury or damage to something in door opening 234. Inertia reel 70 can be easily unlocked by exerting a slight upward motion on door 240. Safe means of lowering door 240 can now be employed.

Figure 5A:
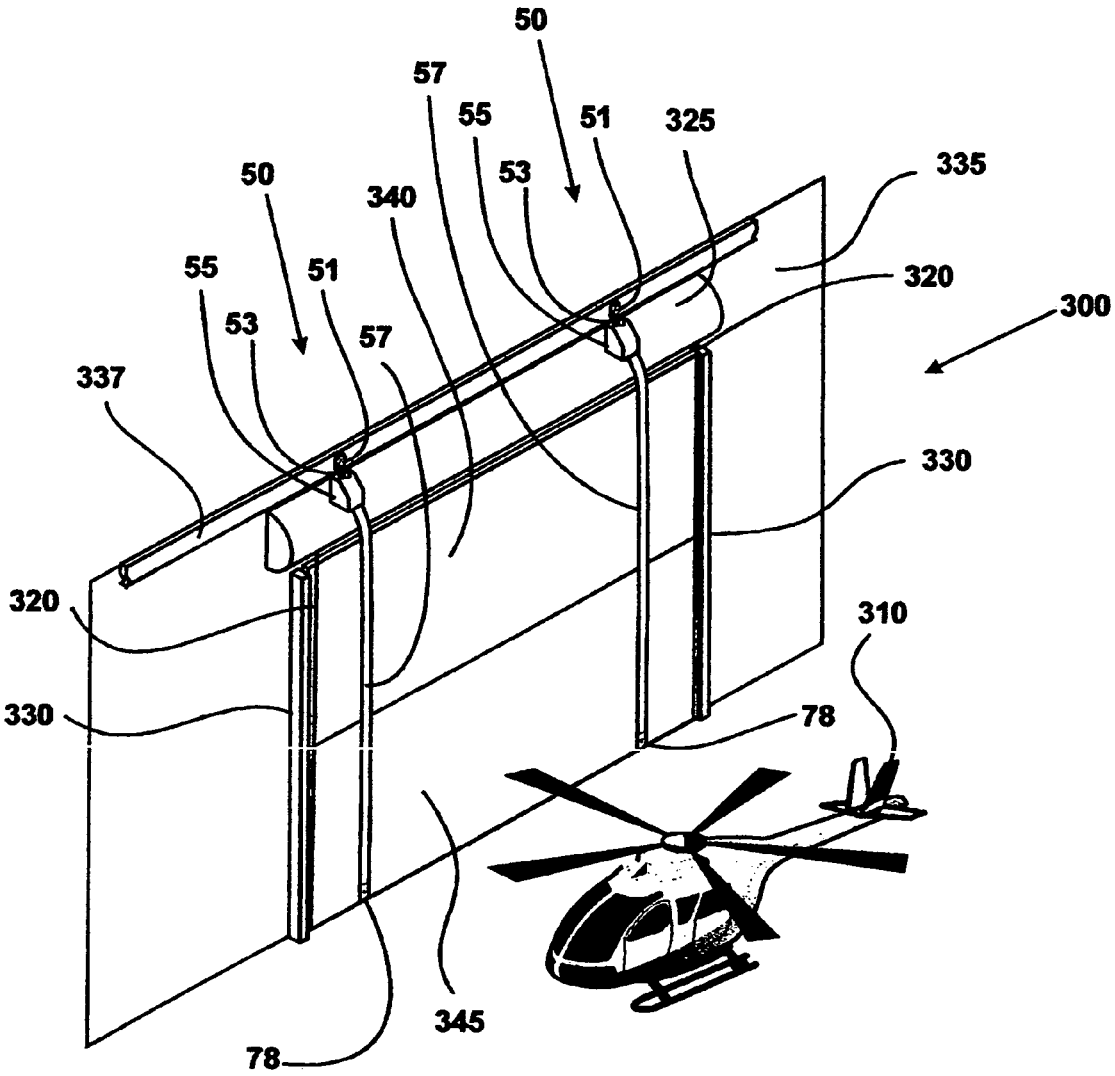
FIG. 5A is an end view of the present invention installed on a bifold door, shown in the closed position.
Figure 5B:
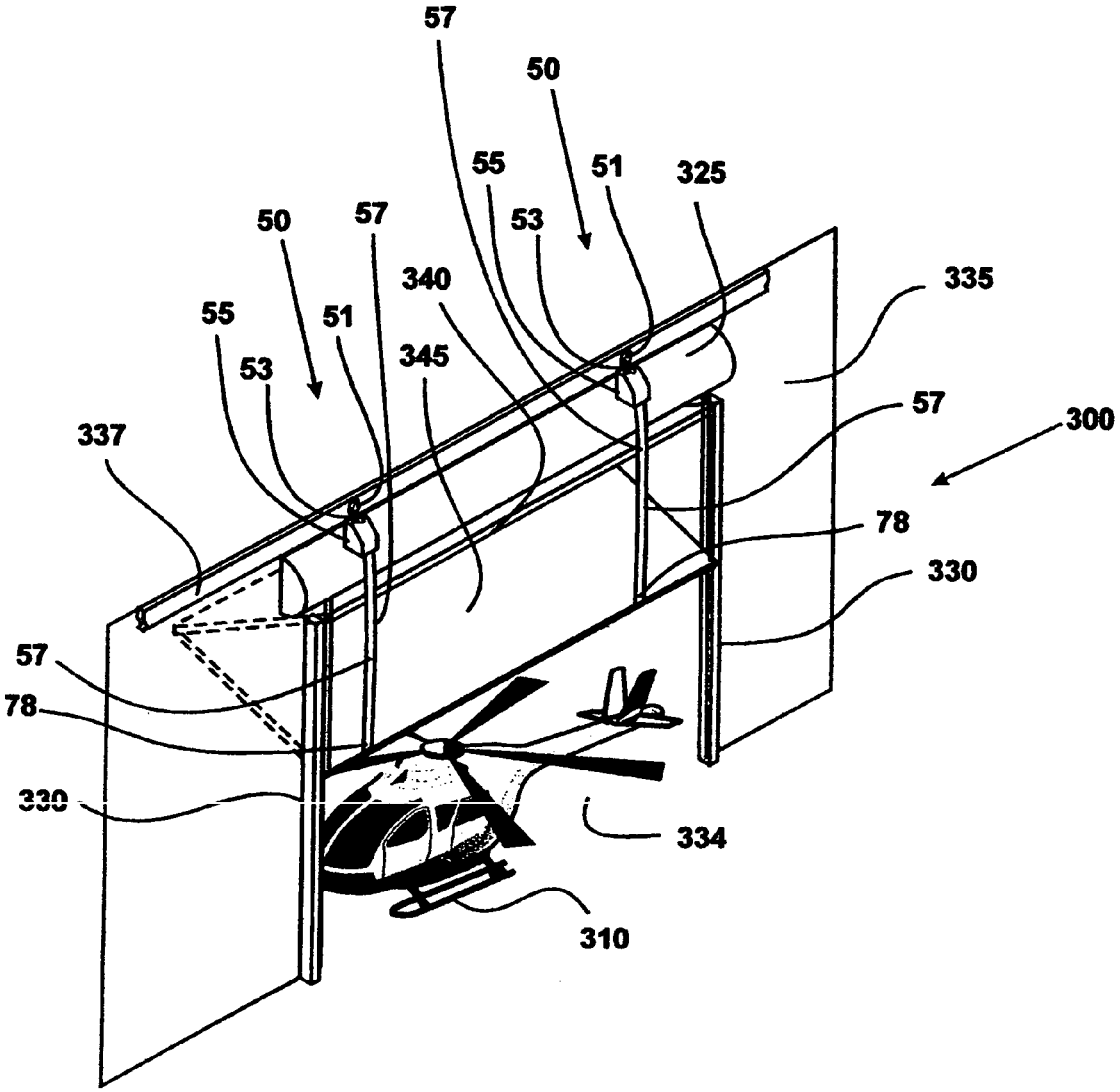
FIG. 5B is an end view of the present invention installed on a bifold door, shown in the open position.

FIGS. 5A and 5B show a bifold door in the closed and open positions, respectively at 300. Bifold doors are commonly used in aircraft hangars. Bifold doors comprise a lower door segment 345 and an upper door segment 340 which are hinged together. Lower door segment 345 and upper door segment 340 hang straight down when closed per FIG. 5A. Cables 320 are attached to the bottom of lower door segment 345. When activated, a mechanism housed in

325 reels up cables 320, causing lower door segment 345 to move up in tracks 330. Lower door segment 345 and upper door segment 340 hinge outward per FIG. 5B.

One or more door drop stop systems 50 is attached to fixed structure 337 by mounting lugs 53 and mounting bolt 51. Strap 57 is attached to lower door segment 345 by mounting means 78. As lower door segment 345 and upper door segment 340 are opened, strap 57 is wound onto inertia reel 70, housed inside rewind box 55. When lowered in the normal manner, lower door segment 345 and upper door segment 340 move downward slowly enough to allow strap 57 to unwind from inertia reel 70 without causing it to lock. In the event of cable breakage or other failure, lower door segment 345 and upper door segment 340 fall quickly, rapidly unwinding strap 57 from inertia reel 70, causing inertial reel 70 to lock. This arrests the downward motion of lower door segment 345 and upper door segment 340, and keeps them from falling farther and causing damage or injury to persons or objects such as aircraft 310 in door opening 334. Inertia reel 70 can be easily unlocked by exerting a slight upward motion on lower door segment 345. Safe means of lowering lower door segment 345 and upper door segment 340, such as a forklift, can now be employed.

Figure 6A:
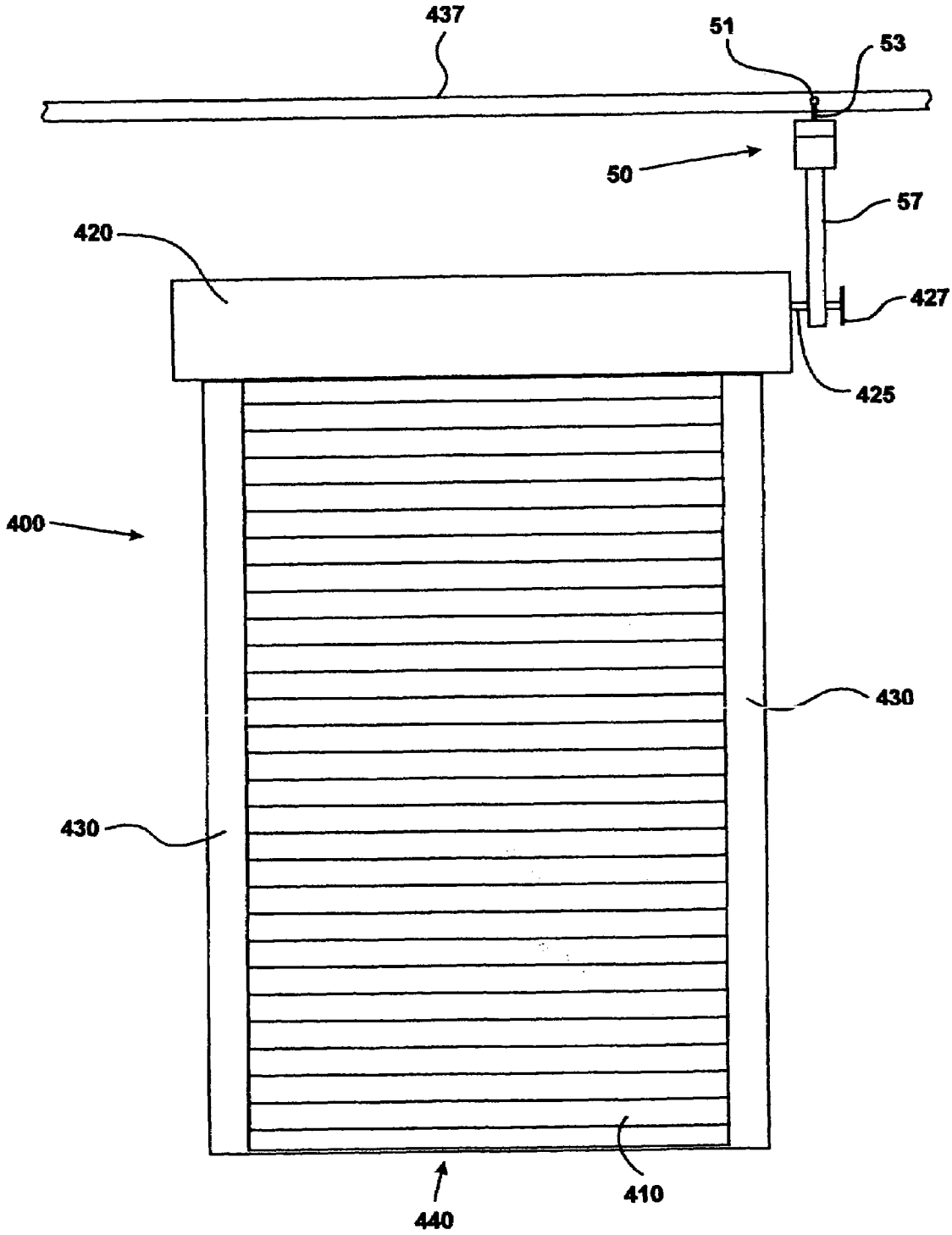
FIG. 6A is a front view of the present invention installed on a rollup door, shown in the closed position.
Figure 6B:
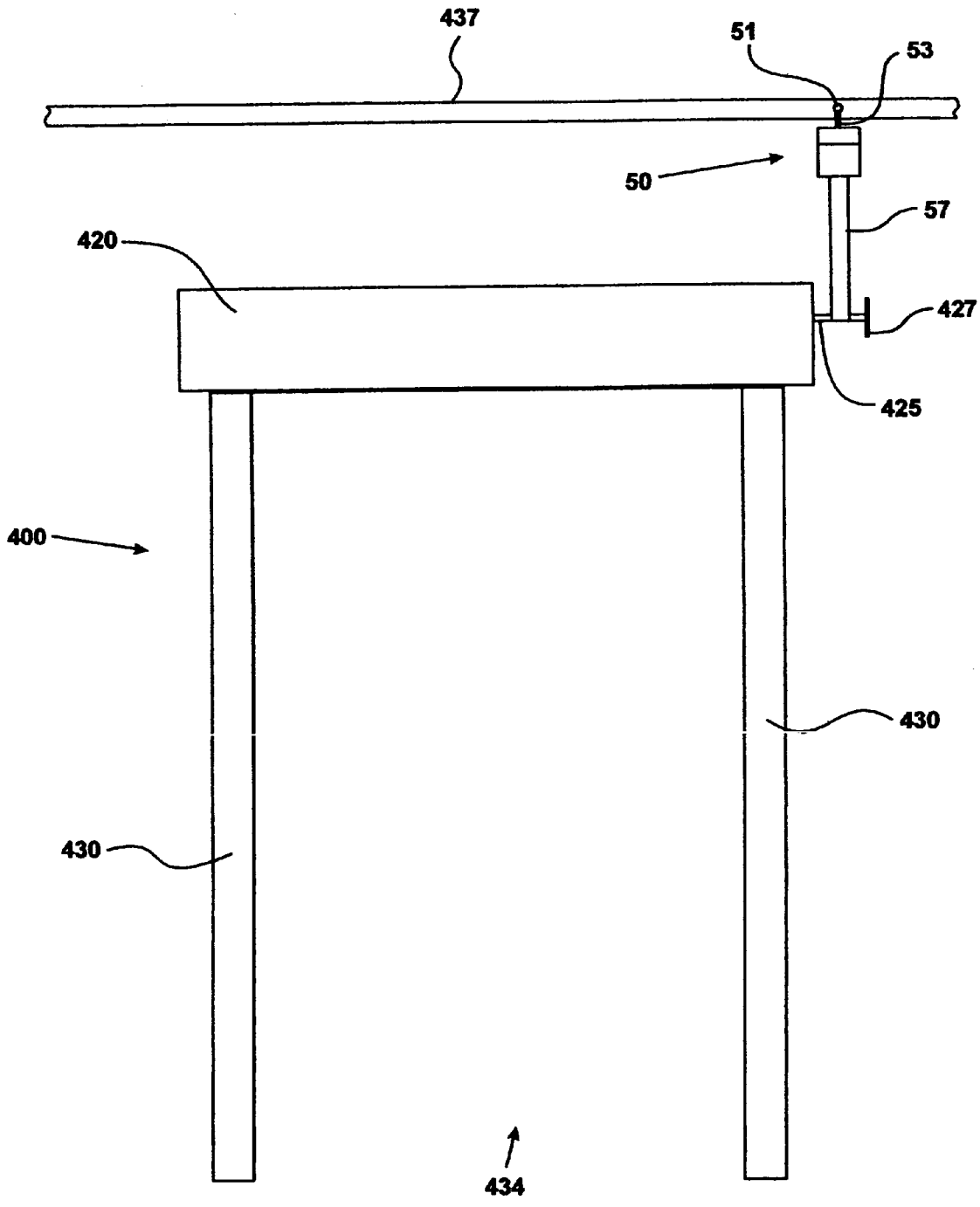
FIG. 6B is a front view of the present invention installed on a rollup door, shown in the open position.

FIGS. 6A and 6B show a rollup door in the open and closed positions, respectively at 400. A rollup door comprises a door 440 with a plurality of segments 410, tracks 430, and a mechanism housed in 420 for rolling up door 440. Protruding from housing 420 is shaft 425 and retainer 427.

Figure 7:
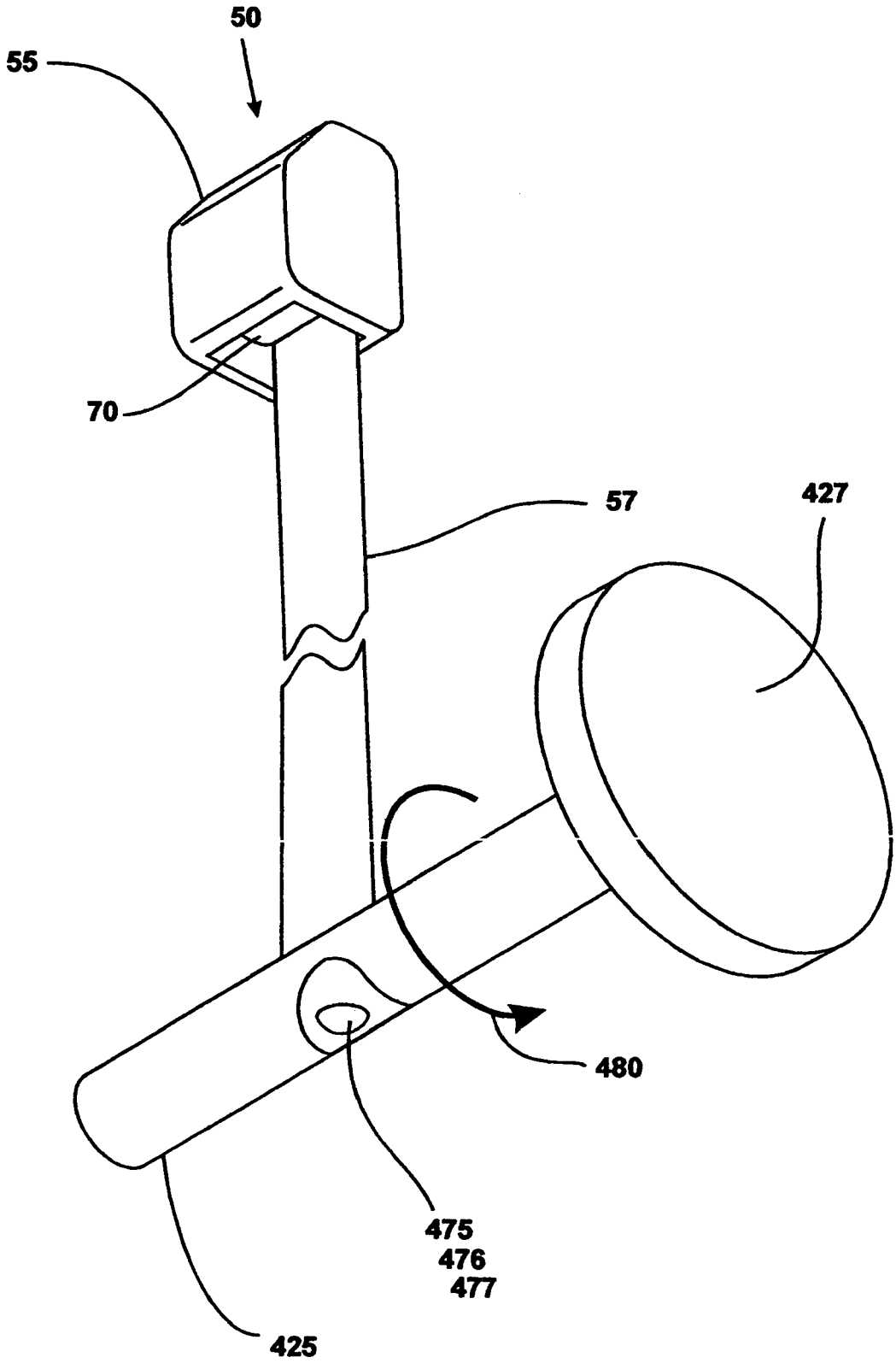
FIG. 7 is a perspective view of how the present invention is installed in a rollup door system.

Door drop stop system 50 comprises rewind box 55 and strap 57. Rewind box 55 is mounted to fixed structure 437 by mounting lugs 53 and mounting means 51, which may be a lag bolt or any other fastener appropriate to the nature of fixed structure 437. Strap 57 is mounted to shaft 425 by means of bolt 475, washer 476, and nut 477 per FIG. 7.

When door 440 is in the full down position, strap 57 is wound around shaft 425, and secured there by retainer 427. When door 440 is being rolled up into housing 420, shaft 425 turns in direction 480, allowing strap 57 to wind back into inertia reel 70.

If any failure occurs which would allow door 440 to free fall, shaft 425 turns rapidly in the direction opposite 480, causing strap 57 to be wound rapidly around shaft 425. This rapid winding pulls strap 57 rapidly off inertia reel 70, causing it to lock and arresting the downward motion of door 440. Inertia reel 70 can be easily unlocked by exerting a slight upward motion on door segment 440. Safe means of lowering lower door 440, such as a forklift, can now be employed.

What is claimed is:

1. A door drop safety system comprising:

a vertically moving overhead door;

a retaining strap having a door mount located on one end thereof, said door mount secured to a portion of said overhead door;

a rewind box mounted to a stationary object;

an inertia reel disposed within said rewind box, a portion of said retaining strap distal to said door mount being wound around said inertia reel;

wherein said retaining strap is of sufficient length to allow said overhead door to fully close; and wherein said inertia reel automatically takes up slack in said retaining strap as said overhead door is raised, automatically unwinds slack in said retaining strap as said overhead door is lowered, but arrests such unwinding movement if the downward acceleration of said overhead door exceeds a predetermined value.

* * * * *